US011105305B2

(12) United States Patent
Boone et al.

(10) Patent No.: US 11,105,305 B2
(45) Date of Patent: Aug. 31, 2021

(54) FUEL INJECTOR CUP WITH FLOW RESTRICTION PASSAGE

(71) Applicant: Hitachi Automotive Systems Americas, Inc., Harrodsburg, KY (US)

(72) Inventors: Anthony Boone, Westland, MI (US); Prashanth Avireddi, Farmington, MI (US); Malcolm Mizuba, Bloomfield, MI (US); Su-Wei Sung, Lexington, KY (US); Minoru Hashida, Northville, MI (US)

(73) Assignee: HITACHI ASTEMO AMERICAS, INC., Harrodsburg, KY (US)

( * ) Notice: Subject to any disclaimer, the term of this patent is extended or adjusted under 35 U.S.C. 154(b) by 0 days.

(21) Appl. No.: 16/855,076

(22) Filed: Apr. 22, 2020

(65) Prior Publication Data

US 2020/0332750 A1 Oct. 22, 2020

Related U.S. Application Data

(60) Provisional application No. 62/836,752, filed on Apr. 22, 2019.

(51) Int. Cl.

| | |
|---|---|
| ***F02M 55/02*** | (2006.01) |
| ***F02M 63/02*** | (2006.01) |
| ***F02M 55/00*** | (2006.01) |

(52) U.S. Cl.

CPC ..... *F02M 55/025* (2013.01); *F02M 55/005* (2013.01); *F02M 63/0275* (2013.01); *F02M 2200/856* (2013.01)

(58) Field of Classification Search

CPC ..... F02M 55/025; F02M 55/005; F02M 63/0275; F02M 2200/856

USPC ..... 123/470, 456

See application file for complete search history.

(56) References Cited

U.S. PATENT DOCUMENTS

| | | | | |
|---|---|---|---|---|
| 7,406,946 | B1 | 8/2008 | Watanabe et al. | |
| 2005/0269427 | A1 | 12/2005 | Cho et al. | |
| 2012/0255522 | A1 | 10/2012 | Kannan et al. | |
| 2015/0226166 | A1* | 8/2015 | Hong | F02M 69/465 123/456 |
| 2016/0003205 | A1* | 1/2016 | Reinhardt | F02M 61/14 123/470 |
| 2016/0333836 | A1* | 11/2016 | Lang | F02M 55/005 |
| 2017/0328325 | A1* | 11/2017 | Scheffel | F02M 61/166 |
| 2019/0136811 | A1* | 5/2019 | Rehwald | F02M 55/025 |
| 2019/0136812 | A1* | 5/2019 | Rehwald | F02M 61/166 |

FOREIGN PATENT DOCUMENTS

DE 102009000183 A1 7/2010

* cited by examiner

*Primary Examiner* — Mahmoud Gimie

(74) *Attorney, Agent, or Firm* — Mattingly & Malur, PC

(57) ABSTRACT

In some examples, a fuel injector rail assembly may include a fuel rail including a tubular body, with a fuel outlet passage formed through a wall of the tubular body. An injector cup may be connected to the tubular body and may include an injector chamber configured to receive a fuel injector. A first fuel passage formed in the injector cup may include a first diameter, and the first fuel passage may be connected to the fuel outlet passage of the tubular body. Additionally, a second fuel passage may be formed in the injector cup between the first fuel passage and the injector chamber. The second fuel passage may have a second diameter that is smaller than the first diameter of the first fuel passage.

17 Claims, 4 Drawing Sheets

FUEL INJECTOR CUP WITH FLOW RESTRICTION PASSAGE

BACKGROUND

Fuel rails for fuel-injected engines typically include tubular structures having multiple fuel injector receptacles referred to as injector cups. Fuel injectors are installed into the injector cups and are operated for injecting fuel into the combustion chambers of an engine. For example, each fuel injector may be associated with a respective combustion chamber of the engine. Further, each fuel injector may be in fluid communication with an interior of the fuel rail through a port in the injector cup. The fuel in the interior of the fuel rail may be maintained under high pressure. The fuel injectors are opened and closed in timing with the reciprocation of the engine to inject fuel into the respective combustion chambers at a desired time. However, pressure pulsations caused by the injectors may pass back into the fuel rail tube, which may cause undesirable noise, vibrations, harshness, or the like.

SUMMARY

Some implementations include arrangements and techniques for a fuel injector rail assembly that may include a fuel rail including a tubular body, with a fuel outlet passage formed through a wall of the tubular body. An injector cup may be connected to the tubular body and may include an injector chamber configured to receive a fuel injector. A first fuel passage formed in the injector cup may include a first diameter, and the first fuel passage may be connected to the fuel outlet passage of the tubular body. Additionally, a second fuel passage may be formed in the injector cup between the first fuel passage and the injector chamber. The second fuel passage may have a second diameter that is smaller than the first diameter of the first fuel passage.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
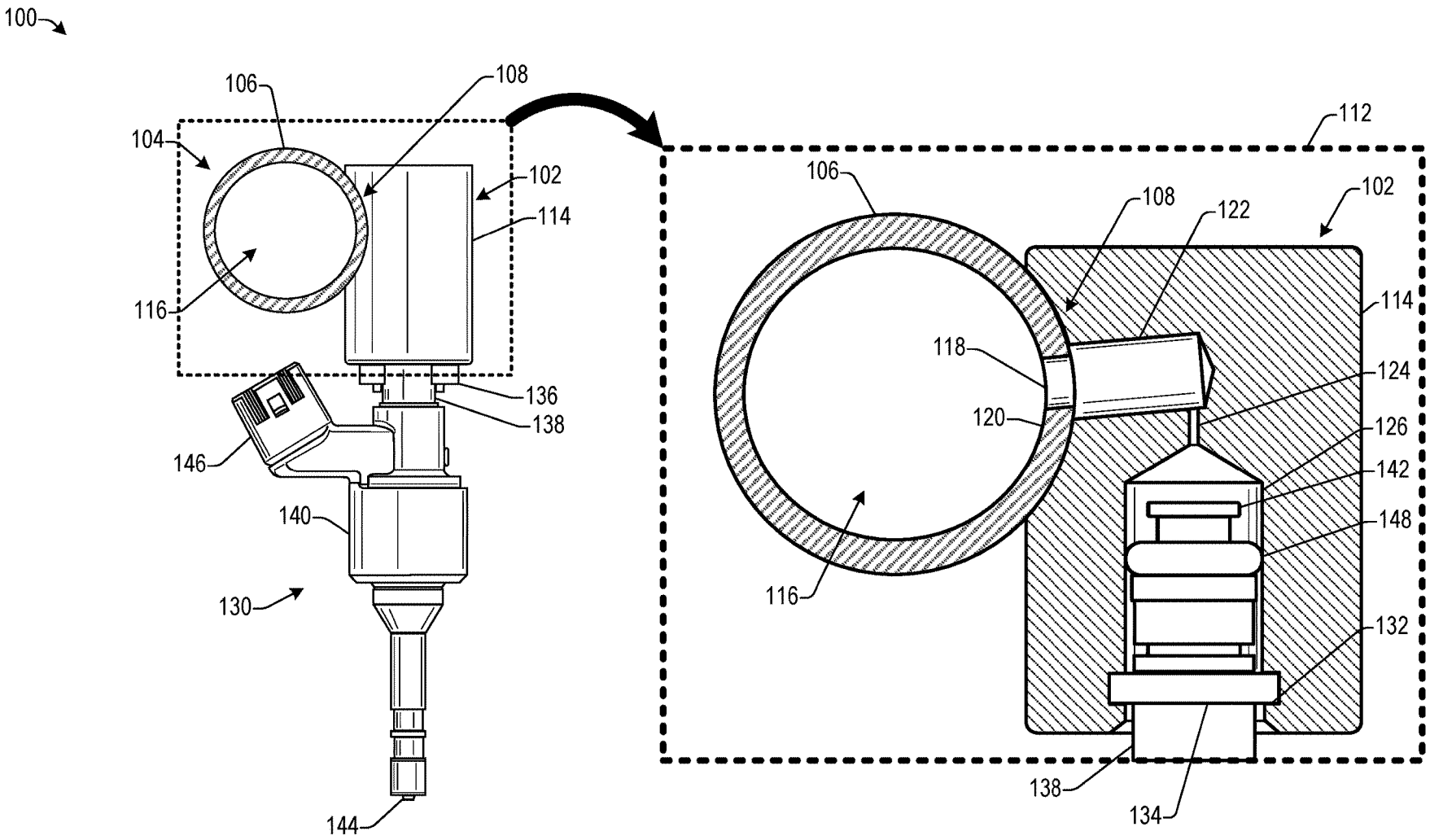
FIG. 1 illustrates an example fuel injector rail assembly, and an enlarged cross section of a tubular body and an injector cup according to some implementations.

Some implementations herein are directed to techniques and arrangements for a fuel rail assembly having at least one injector cup configured for receiving a fuel injector with a flow restriction passage disposed within the injector cup. For instance, the flow restriction passage may be included in the injector cup at a location upstream of the injector so that fuel rail noise, vibration and/or harshness, including audible noise, may be reduced. As one example, the flow restriction passage may be located directly above the injector inlet, and may form the aperture to the injector chamber in which the injector is inserted.

Disposing the fuel restriction passage within the injector cup above the injector chamber, rather than, e.g., at the inlet from the fuel rail tube, may reduce the risk of having brazing material, or the like, block the fuel passage during fabrication. Additionally, disposing the restrictive passage in this location allows the injector cup with the restrictive passage to be made using techniques compatible with conventional fuel delivery system assembly methods other than brazing, such as by forging, casting, 3D printing, and so forth. Thus, implementations herein provide a flow restriction passage having a size and location that reduces the transmission of pressure pulsations back into the fuel rail tube, such as may be caused by the injector, while also reducing the risk of the flow restriction passage being blocked by brazing material, or the like, during fabrication.

The flow restriction passage within the injector cup is smaller in diameter than an upstream first fuel passage that is in fluid communication with the outlet passage from the fuel rail tube that feeds fuel to the restrictive passage. The flow restriction passage is also smaller in diameter than the downstream injector chamber that receives the fuel injector and where the fuel injector receives the fuel. In some examples, the first passage may have a larger diameter than the outlet passage of the fuel rail tube. In addition, the flow restriction passage fluidly connects the between the first passage and the injector chamber.

Accordingly, a fuel injector may be inserted into the injector chamber in the injector cup and is securely retained in the injector chamber as discussed additionally below. During operation of the fuel injector, the flow restriction passage by being substantially smaller in diameter than the first passage and the injection chamber, serves to reduce, minimize or otherwise limit pressure pulsations that would otherwise be transmitted from the fuel injector in the injector chamber back into the fuel rail tube, and which would be a source of audible noise.

For discussion purposes, some example implementations are described in the environment of a fuel rail assembly including an injector cup for receiving a fuel injector and which may be used for a fuel injected internal combustion engine. However, implementations herein are not limited to the particular examples provided, and may be extended to other types of equipment configurations, other environments of use, other apparatuses, and so forth, as will be apparent to those of skill in the art in light of the disclosure herein.

FIG. 1 illustrates an example fuel injector rail assembly 100 and an enlarged cross section of an injector cup 102 according to some implementations. The fuel rail assembly 100 includes a fuel rail 104, which includes a tubular body 106, which may be a hollow cylinder that is filled with pressurized fuel during operation of the fuel system of an engine (not shown in FIG. 1). For example, the fuel rail 104 may be constructed from stainless steel or other durable material able to withstand high internal pressures.

The fuel rail 104 may include one or more of the injector cups 102 that are integral with or otherwise attached to the tubular body 106. For example, the injector cups 102 may be attached to the tubular body 106 at a join region 108, such as by brazing, welding, soldering, mechanical fastening, combinations thereof, or the like. When there are multiple injector cups 102, the injector cups 102 may be spaced along the length of the tubular body 106. For example, there may typically be two, three, four, five or six of the injector cups 102 mounted along the length of the tubular body 106 of the fuel rail 104.

An enlarged cross section taken along a center of the injector cup 102 and across the tubular body 106 at the same position is illustrated inside a dashed-line box 112. Each injector cup 102 may have a cylindrical body 114 having a partially hollow interior that is in fluid communication with a hollow interior 116 of the tubular body 106 of the fuel rail 104 through a series of passages. In particular, a fuel outlet passage 118 formed through a wall 120 of the tubular body 106 is in fluid communication with a first fuel passage 122 formed in the cylindrical body 114 of the injection cup 102.

The first fuel passage 122 is also in fluid communication with a second fuel passage 124 that extends downward from the first fuel passage 122 to form a fluid connection between the first fuel passage 122 and an injector chamber 126. Accordingly, when a fuel injector 130 is installed inside the injector chamber 126 of the injector cup 102, the fuel is able to pass under high pressure from the hollow interior 116 of the fuel rail 104, through the fuel outlet passage 118, the first fuel passage 122, the second fuel passage 124, into the injector chamber 126, and into the fuel injector 130.

In some examples, the fuel outlet passage 118, the first fuel passage 122, the second fuel passage 124, and the injector chamber 126 may each be generally cylindrical in shape, e.g., a hollow cylindrical bore or hole, and may each have a different sized diameter. For example, the diameter of the second fuel passage 124 is substantially smaller than the diameter of the first fuel passage 122 and the diameter of injector chamber 126 so that the second fuel passage 124 serves as a flow restriction passage that limits pressure pulsations from the fuel injector 130 back to the fuel rail 104, thereby reducing or otherwise limiting fuel rail noise which may include audible noise, vibration and/or harshness.

The injector cup 102 serves as a receptacle for receiving the fuel injector 130. Thus, the fuel injector 130 may be inserted into the injector chamber 126 of the injector cup 102 and securely retained therein. As one example, the fuel injector 130 may be rotated following insertion so that the injector 130 is retained in the injector cup 102 by a retaining shelf 132 that contacts a retaining member 134 on the fuel injector 112. For instance, the retaining member 134 of the fuel injector 130 may be inserted past the retaining shelf 132 of the injector cup 102, and the fuel injector 130 may be rotated to an installed position so that the retaining shelf 132 prevents removal of the fuel injector 130 from the injector cup 102.

In addition, in some examples, a retaining clip 136, or the like, may be installed onto a stem 138 of the fuel injector 130 to further prevent removal of the fuel injector 130 from the injector cup 102, such as for preventing relative rotation between the fuel injector 130 and the injector cup 102. Further, while one example of retaining the fuel injector 130 in the injector cup 102 is illustrated in this example, implementations herein are not limited to any particular configuration or techniques for installing the fuel injector 130 into the injector cup 102.

The fuel injector 130 includes an injector body 140, an inlet end 142, and an outlet end 144. The fuel injector 130 further includes an electrical connector 146 that extends from one side of the fuel injector 130 for connecting to the electrical system of a vehicle following installation of the fuel rail assembly 100 to the engine. For example, electrical signals may be provided through the electrical connector 146 for opening and closing the fuel injector 130 during operation of the engine. The injector 130 may further include an O-ring 148 located at the inlet end 142 for forming a seal with the interior of the injector chamber of the injector cup 102 when the fuel injector 130 is installed into the injector cup 102.

Figure 2:
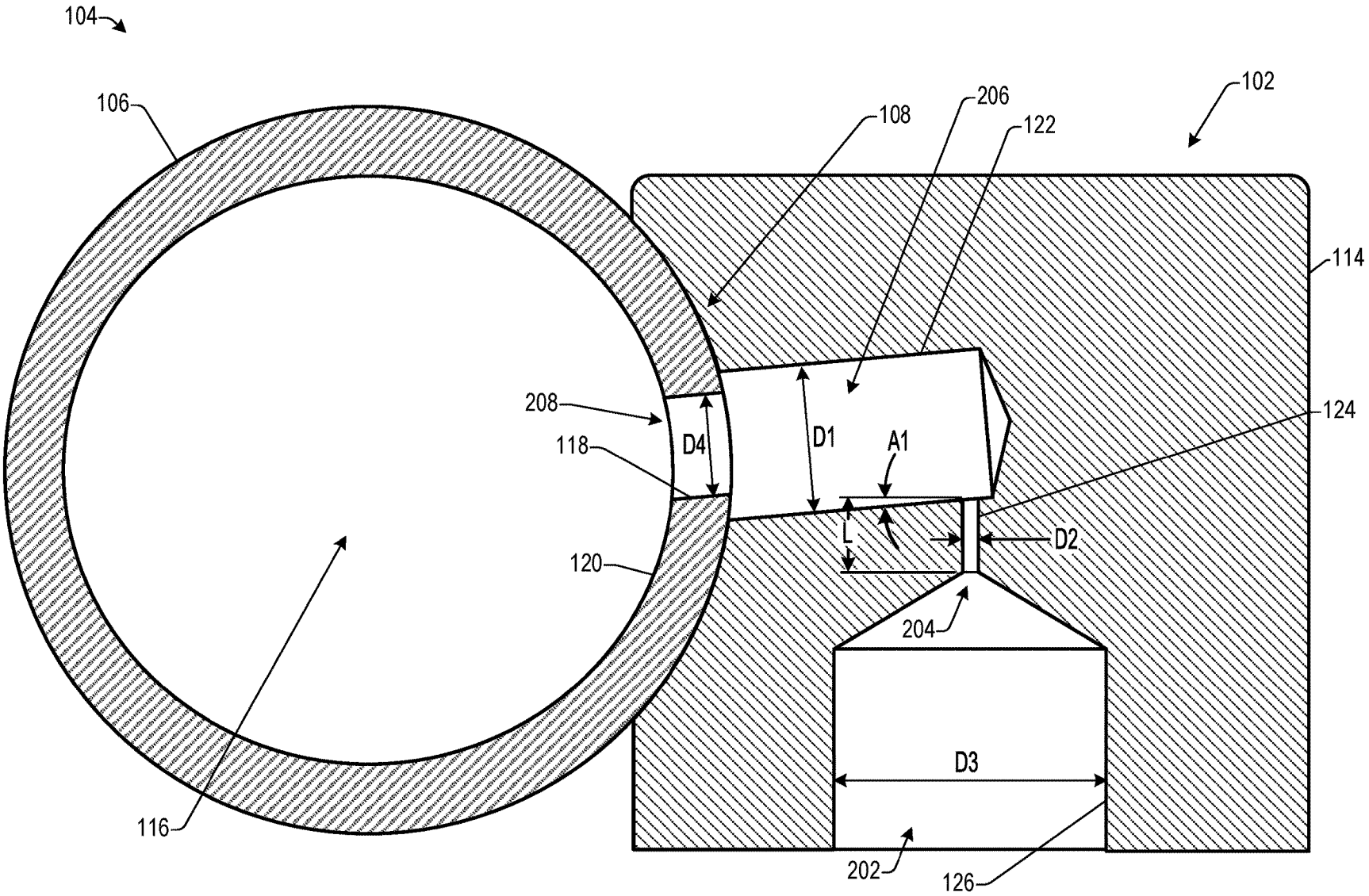
FIG. 2 illustrates an enlarged view of the cross section of the injector cup and fuel rail according to some implementations.

FIG. 2 illustrates an enlarged view of the cross section of the injector cup 102 and fuel rail 104 according to some implementations. In this example, the fuel injector 130 is removed for clarity of illustration. The tubular body 106 includes the hollow interior 116 for receiving pressurized fuel, such as from a fuel pump (not shown in FIG. 2). The fuel outlet passage 118 places the hollow interior 116 of the fuel rail 104 in fluid communication with the first fuel passage 122 in the injector cup 102. The second fuel passage 124 fluidly connects the first fuel passage 122 to the injector chamber 126, while the size and position of the second fuel passage 124 serve to limit pressure pulsations from the fuel injector 130 (not shown in FIG. 2) and injector chamber 126.

In the example of FIG. 2, the first fuel passage 122 has a first internal diameter D1 that is greater than a second internal diameter D2 of the second fuel passage 124. Further, the first internal diameter D1 and the second internal diameter D2 are both smaller than a third internal diameter D3 of the injector chamber 126. Additionally, the fuel outlet passage 118 of the fuel rail 104 has a fourth internal diameter D4 that may be smaller than or similar in size to the first diameter D1 of the first fuel passage 122.

As several non-limiting examples, the second internal diameter D2 of the second fuel passage 124 may be between 0.5 and 1.5 mm, while the first internal diameter D1 of the first fuel passage 122 may be between 2.5 and 7.5 mm, and the third internal diameter D3 of the injector chamber 126 may be between 7.5 mm and 15 mm. The third internal diameter D3 of the injector chamber 126 may be dependent at least in part on the size of the inlet end 142 and the O-ring 148 of the fuel injector 130 and vice versa. As still another example, the second internal diameter D2 of the second fuel passage 124 may be ⅛ to ¼ the size of the first internal diameter D1 of the first fuel passage 122. Further, as still another example, a length L of the second fuel passage 124 between the first fuel passage 122 and the injector chamber 126 may be between 0.75 and 4 mm. Further, while several example dimensions are provided herein, numerous variations will be apparent to those of skill in the art having the benefit of the disclosure herein.

In addition, in the illustrated example, a cylindrical bore 202 of the injector chamber 126 may be concentric (axially aligned) with the cylindrical body 114 of the injector cup 102, such as when viewed from below. Further, a cylindrical bore 204 of the second fuel passage 124 may also be concentric (axially aligned) with the cylindrical bore 202 of the injector chamber 126 and the cylindrical body 114 of the injector cup 102. Similarly, a cylindrical bore 206 of the first fuel passage 122 may be concentric (axially aligned) with a cylindrical bore 208 of the fuel outlet passage 118. Furthermore, while cylindrical passages are described in the examples herein, one or more of the passages 118, 122, 124 and or the injector chamber 126 may have different shapes or configurations.

Furthermore, in some examples, the bore 206 of the first fuel passage 122 and the bore 208 of the fuel outlet passage 118 may be tilted at an angle A1 relative to the bore 204 of the second fuel passage 124. Thus, the first fuel passage 122 and the second fuel passage may intersect at an acute angle that is less than 90 degrees by an amount of the angle A1. Accordingly, the angle A1 may further reduce transmission of pressure pulsations back to the fuel rail 104.

In addition, in the illustrated example, the fourth internal diameter D4 of the fuel outlet passage 118 is smaller than the first internal diameter D1 of the first fuel passage 122, but is larger than the second internal diameter D2 of the second fuel passage 124. Alternatively, in some examples, the fourth internal diameter D4 of the fuel outlet passage 118 may be the same as or larger than the first internal diameter D1 of the first fuel passage 122.

In some cases, the injector cup 104 may be brazed on to the fuel rail tube 102 at the join region 108 or may be attached using any of various other manufacturing techniques. Accordingly, examples herein may also apply to other fuel rail assembly methods other than brazing assembly, such as forging, casting, 3D printing, welding, soldering, mechanical fastening, etc. The location of the second fuel passage 124 immediately upstream of the injector chamber 126 makes the second fuel passage 124 accessible to drilling through the injector chamber 126 or by other machining techniques, and therefore the attachment method of the injector cup 102 to the fuel rail tube 102 is not a limiting factor.

Figure 3:
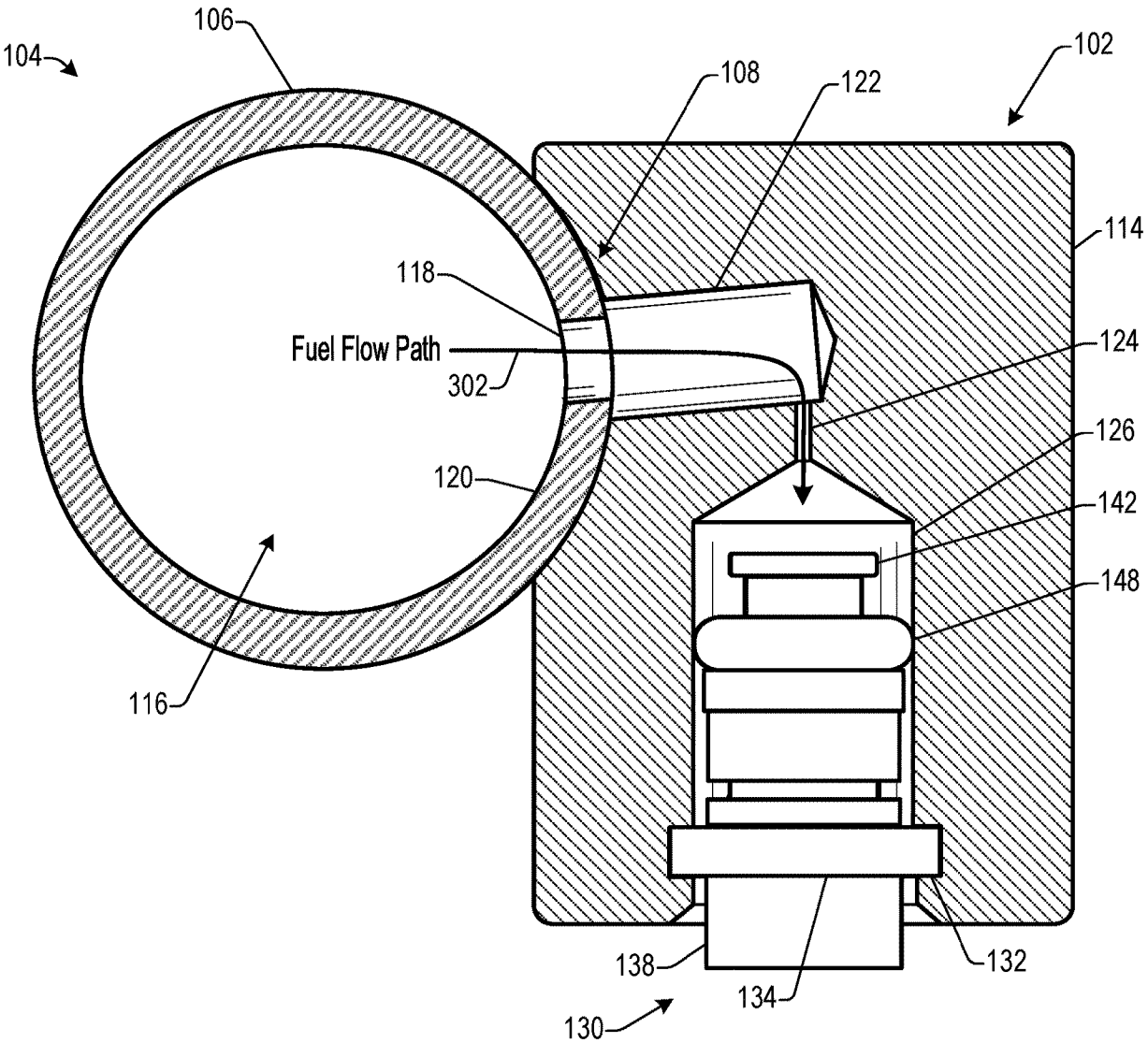
FIG. 3 illustrates an example fuel flow path according to some implementations.

FIG. 3 illustrates an example fuel flow path 302 according to some implementations. The fuel under high pressure in the hollow interior 116 of the tubular body 106 follows the fuel flow path 302 from the hollow interior 116 of the fuel rail tube 102, through the fuel outlet passage 118, the first fuel passage 122, the second fuel passage 124, the injector chamber 126, into and through the fuel injector 130 when the fuel injector 130 is activated by through the electrical connector 146. Depending on the engine speed, the fuel injector may cycle on and off many times per second. For example, for an engine speed of 3000 rpm, an injector may typically cycle 25 pulses per second. Accordingly, the fuel, being relatively non compressible, moves along the flow path in a start/stop fashion corresponding to the cycles of the fuel injectors, which can cause pressure pulsations in the fuel.

Figure 4:
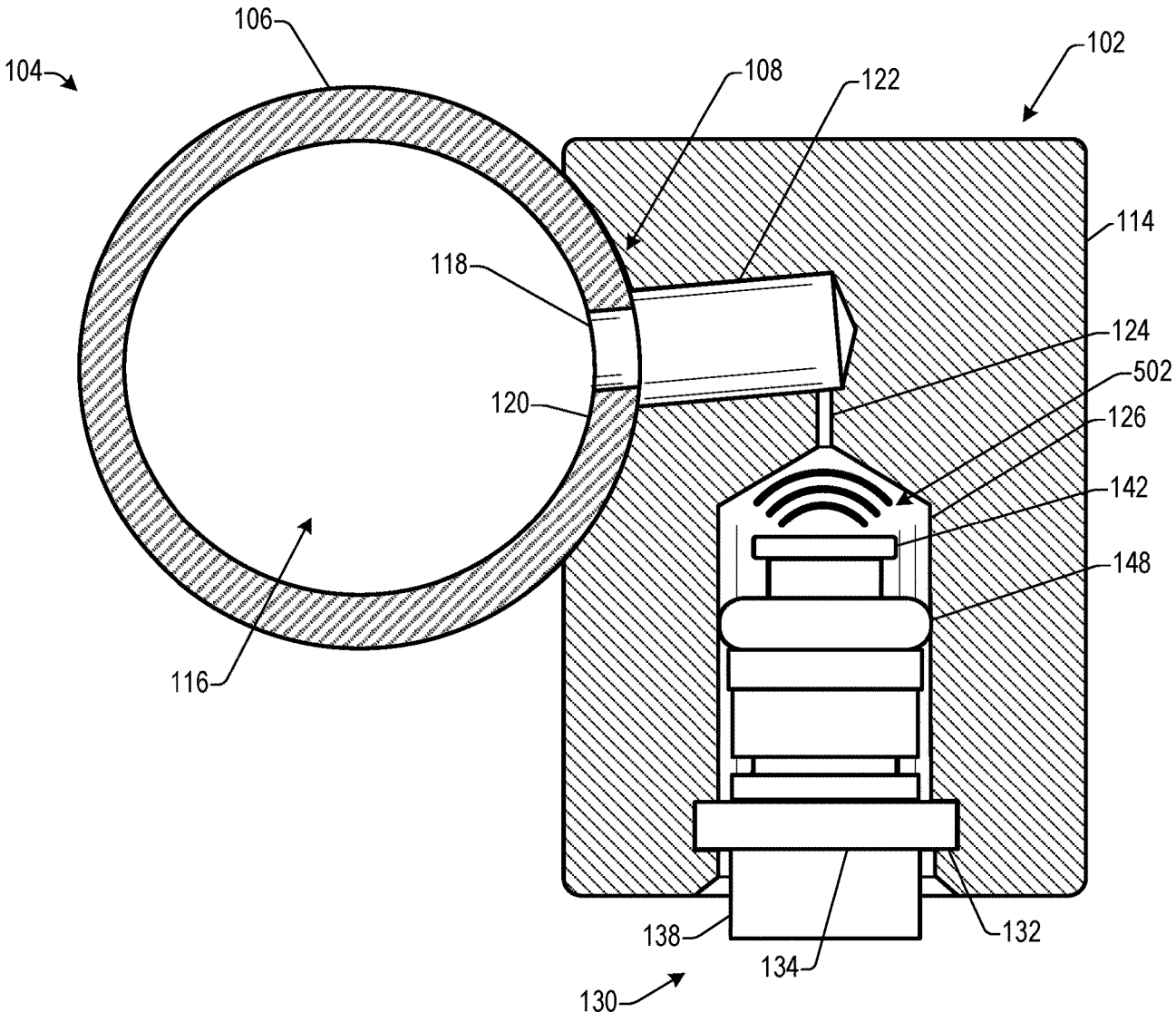
FIG. 4 illustrates an example of limiting pressure pulsations according to some implementations.

FIG. 4 illustrates an example of limiting pressure pulsations 502 according to some implementations. For example, as discussed above, pressure pulsations 502 may emanate from the fuel injector 130, inside the injector chamber 126 such as due to cycling the fuel injector open and closed. The pressure pulsations 502 may attempt to travel back along the fuel path toward the injector rail 104. However, the size and configuration of the second fuel passage 124 limits the pressure pulsations able to reach the fuel rail 104. As a result, noise, including, but not limited to audible noise, vibration and harshness are reduced by the inclusion of the second fuel passage 124 between the first fuel passage 122 and the injector chamber 126. For example, without the configuration of the second fuel passage 124, a pulsation path from the fuel injector inlet 142 to the fuel rail 104 may transmit pulsations through the injector cup 102 to the tubular body 106 of the fuel rail 104, which results in sound and vibrations being emitted from the fuel rail 104. For instance, the tubular body 106 of the fuel rail 104 may tend to amplify the pulsations into audible noise. On the other hand, the second fuel passage 124 due to its reduced diameter and controlled length can substantially reduce fuel pulsations passed from the fuel injector 130, through the injector cup 102 and back to the fuel rail 104.

In addition, by locating the second fuel passage 124 in the injector cup 102, such as immediately upstream of the fuel injector 130, the restrictive passage is positioned in a location that is away from the join region 108 at which the injector cup 104 is attached to the tubular body 106 of the fuel rail 104, such as by brazing or the like. For example, during brazing, hot flowing liquid copper or other brazing material may be inserted between the injector cup 102 and the tubular body 106 at the join region 108 to seal the injector cup 102 to the tubular body 106. Accordingly, if the second fuel passage 124 were to be located in near the join region 108, there may be a substantial risk of the second fuel passage 124, due to its relatively small second internal diameter D2, being partially or completely blocked by the brazing material, which might render the associated injector inoperative. Thus, implementations herein reduce or eliminate the risk of blocking the smaller restrictive passage while providing an effective solution for limiting transmittal of pressure pulsations to the tubular body 106 of the fuel rail 104.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed:

1. An apparatus comprising:

a fuel rail for fuel delivery to an engine, the fuel rail including a tubular body, with a fuel outlet passage formed through a wall of the tubular body;

an injector cup connected to the tubular body, the injector cup including:

an injector chamber configured to receive a fuel injector;

a first fuel passage formed in the injector cup, the first passage having a first diameter, the first fuel passage in fluid communication with the fuel outlet passage for receiving fuel from the tubular body through the fuel outlet passage; and a second fuel passage formed in the injector cup between the first fuel passage and the injector chamber, the second passage in fluid communication with the first fuel passage and the injector chamber for passing fuel from the first fuel passage to the injector chamber, wherein the second fuel passage has a second diameter that is smaller than the first diameter of the first fuel passage to limit passage of pressure pulsations, wherein a size of the second diameter of the second fuel passage is between ⅛ to ¼ a size of the first diameter of the first fuel passage.

2. The apparatus as recited in claim 1, wherein the second diameter of the second fuel passage is between 0.5 and 1.5 mm, and the first diameter of the first fuel passage is between 2.5 and 7.5 mm.

3. The apparatus as recited in claim 2, wherein a diameter of the injector chamber is between 7.5 and 15 mm.

4. The apparatus as recited in claim 1, wherein the second fuel passage has a length between 0.75 and 4 mm.

5. The apparatus as recited in claim 1, wherein the second fuel passage has a bore that is concentric with a bore of the injector chamber, the bore of the second fuel passage intersecting with a bore of the first fuel passage at an acute angle.

6. An apparatus comprising:

a fuel rail for fuel delivery to an engine, the fuel rail including a tubular body;

an injector chamber configured to receive a fuel injector;

a first fuel passage in fluid communication with a fuel outlet passage in the tubular body, the first fuel passage having a first diameter; and a second fuel passage connecting between the first fuel passage and the injector chamber, wherein the second fuel passage has a second diameter that is smaller than the first diameter of the first fuel passage, wherein a size of the second diameter of the second fuel passage is between ⅛ to ¼ a size of the first diameter of the first fuel passage.

7. The apparatus as recited in claim 6, further comprising an injector cup attached to the tubular body, the injector cup including the injector chamber, the second fuel passage, and the first fuel passage.

8. The apparatus as recited in claim 6, wherein the second diameter of the second fuel passage is between 0.5 and 1.5 mm, and the first diameter of the first fuel passage is between 2.5 and 7.5 mm.

9. The apparatus as recited in claim 8, wherein a diameter of the injector chamber is between 7.5 and 15 mm.

10. The apparatus as recited in claim 6, wherein the second fuel passage has a length between 0.75 and 4 mm.

11. The apparatus as recited in claim 6, wherein the second fuel passage has a bore that is concentric with a bore of the injector chamber, the bore of the second fuel passage intersecting with a bore of the first fuel passage at an acute angle with respect to a direction of fuel flow.

12. A fuel injector rail assembly comprising:

a fuel rail including a tubular body, with a fuel outlet passage formed through a wall of the tubular body;

an injector cup connected to the tubular body, the injector cup including:

an injector chamber configured to receive a fuel injector;

a first fuel passage formed in the injector cup, the first passage having a first diameter, the first fuel passage connected to the fuel outlet passage; and a second fuel passage formed in the injector cup between the first fuel passage and the injector chamber, wherein the second fuel passage has a second diameter that is smaller than the first diameter of the first fuel passage, wherein a size of the second diameter of the second fuel passage is between ⅛ to ¼ a size of the first diameter of the first fuel passage.

13. The fuel injector rail assembly as recited in claim 12, wherein the second diameter of the second fuel passage is between 0.5 and 1.5 mm, and the first diameter of the first fuel passage is between 2.5 and 7.5 mm.

14. The fuel injector rail assembly as recited in claim 13, wherein a diameter of the injector chamber is between 7.5 and 15 mm.

15. The fuel injector rail assembly as recited in claim 12, wherein the second fuel passage has a length between 0.75 and 4 mm.

16. The fuel injector rail assembly as recited in claim 12, wherein the second fuel passage has a bore that is concentric with a bore of the injector chamber.

17. The fuel injector rail assembly as recited in claim 12, wherein a bore of the second fuel passage intersects with a bore of the first fuel passage at an acute angle with respect to a direction of fuel flow.

* * * * *